US006740201B1

(12) United States Patent
Holopainen et al.

(10) Patent No.: US 6,740,201 B1
(45) Date of Patent: May 25, 2004

(54) METHOD FOR USING WATER HYDRAULICS IN A PAPER OR BOARD MACHINE

(75) Inventors: Kari Holopainen, Muurame (FI); Juha Kinnunen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 91 days.

(21) Appl. No.: 10/148,643

(22) PCT Filed: Nov. 13, 2000

(86) PCT No.: PCT/FI00/00986

§ 371 (c)(1),
(2), (4) Date: Aug. 23, 2002

(87) PCT Pub. No.: WO01/40572

PCT Pub. Date: Jun. 7, 2001

(30) Foreign Application Priority Data

Dec. 3, 1999 (FI) ..... 19992603

(51) Int. Cl.[7] ..... D21F 1/00

(52) U.S. Cl. ..... 162/199; 162/189; 162/175; 162/164.1; 162/164.6; 162/168.3

(58) Field of Search ..... 162/189–190, 162/158, 175, 164.1, 164.6, 168.3, 199, 272; 210/928; 184/54, 109

(56) References Cited

U.S. PATENT DOCUMENTS 4,167,964 A 9/1979 Flury
4,558,960 A 12/1985 Lehtinen et al.
5,620,566 A 4/1997 Holopainen
5,968,317 A * 10/1999 Gartz et al. ..... 162/190

FOREIGN PATENT DOCUMENTS

EP 0 273 460 A2 7/1988
EP 712455 B1 * 10/2001 ..... D21F/3/02
FI 76409 6/1988
FI 942616 6/1994
WO WO 01/40572 A1 6/2001

OTHER PUBLICATIONS

International Preliminary Examination Report issued in International Patent Application No. PCT/FI00/00986.
Search Report issued in Finnish Priority Application No. 19992603.

* cited by examiner

*Primary Examiner*—José A. Fortuna
(74) *Attorney, Agent, or Firm*—Stiennon & Stiennon

(57) ABSTRACT

Water hydraulics are used in a paper or board machine, in particular in applications requiring lubrication and in the like in which an operating medium is subjected to pressure. A chemical which is used in the stock system (A) of the process is mixed with the water used in water hydraulics before the water is passed to a site of application (5) in order to raise the viscosity of the water and chemical mixture to a level required by the site of application (5). The water and chemical mixture is passed ($\mathbf{3}_{in}$) after that to the site of application (5) and circulated through the same at least once, after which said water and chemical mixture is recovered (2) and passed to the stock system (A) of the process as diluted to a suitable concentration.

24 Claims, 2 Drawing Sheets

METHOD FOR USING WATER HYDRAULICS IN A PAPER OR BOARD MACHINE

CROSS REFERENCES TO RELATED APPLICATIONS

This application is a U.S. national stage application of International Application No. PCT/FI00/00986, filed Nov. 13, 2000, and claims priority on Finnish Application No. 19992603 filed Dec. 3, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for using water hydraulics in a paper or board machine, in particular in applications requiring lubrication and in the like in which an operating medium is subjected to pressure.

SUMMARY OF THE INVENTION

Conventionally, in paper and board machines, oil is used in several applications as an operating liquid, in cooling systems, in bearing arrangements, etc. The apparatus must be tightly encased to prevent the drawbacks of oil leakages in order that oil should not be allowed to damage the product which is being manufactured, such as paper or board, or to contaminate the devices situated in the surroundings. Moreover, when oil gets into the environment, for example, with waters discharging from a mill, it is very harmful because of the pollution of the environment. Considerable amounts of heat are generated in different bearing applications of rolls and it is therefore necessary to use in these bearing applications large cooling systems, in which lubricating oil is most commonly cooled by means of water. Possible oil leakages often get into the environment and, as already stated above, the disposal of oil causes substantial loadings to the environment. Additionally, hot oil is a risk factor in terms of fire safety. When thinking, for example, of the rolls which are used in paper machines and which are loaded with hydraulic oil and journalled with slide bearings, the hydraulic medium demand per roll is substantial. As an example, it may be mentioned that about 10 to 12 $m^3$ of hydraulic oil is needed for one deflection-compensated roll loaded with hydraulic oil. When one machine includes a considerable number of such rolls, the paper mill has to keep a very large stock of hydraulic oil.

Electricity is used as driving power in several devices, in which connection it is necessary to set special requirements for these electric motors because of the humid surroundings. In addition, in some equipment in paper machines, air is used as driving power, which again requires a separate pneumatic system of its own. When it is necessary to use simultaneously several different types of driving power and to build several different operating medium lines, to encase devices, to construct special arrangements because of fire safety, etc., these actions cause, of course, considerable costs, and further this kind of solutions require an abundance of space to place the equipment in machines. Today, attempts are being made to achieve durable arrangements which protect the environment, are economical and take little space, in which connection more and more attention is being paid to the use of environmentally friendly and economical water as driving power instead of other operating mediums.

With respect to the prior art relating to water hydraulic systems, reference is made, for example, to Finnish patent 76 409 which describes journal bearings which are suitable for rotating transfer rolls and spreader rolls and in which water is used as lubricant. The use of water is suitable for this kind of system because the operating medium is not subjected to high pressure in the system. The system described in this Finnish patent cannot be applied to a system under high pressure.

U.S. Pat. No. 4 167 964 describes an apparatus intended for rolling of metal, which apparatus uses rolls loaded with a pressure medium. In the case described in this publication, water is used as the pressure medium. In addition to pressurization, water is used in the system for lubrication and for cooling. In spite of high working pressures, the use of water is feasible in the system because a very high flow rate of water is used in addition to pressurization. If the used flow of water were slight, it could not be used for pressurization because of the low viscosity of water.

Finnish patent application No. 942616 discloses a pre-press for a paper web, in particular a shoe press, in which water is used as the operating liquid in a loading shoe. Water serves in the system simultaneously as a lubricating medium and as a medium producing a loading pressure. The use of water also in this arrangement is possible because the loading pressures used are not very high and, in addition, the flow of the loading medium is high at the same time. In that connection, the low viscosity is not too detrimental from the point of view of the use of the arrangement.

The aim of the present invention is to provide a method which allows the use of water hydraulics in a paper and board machine also in applications in which the operating medium is subjected to a considerable pressure. With a view to achieving this aim, the invention is mainly characterized in that some chemical used in the stock system of the process is mixed with the water used in water hydraulics before the water is passed to a site of application in order to raise the viscosity of the water and chemical mixture to a level required by the site of application, the water and chemical mixture is passed to the site of application and circulated through the same at least once, after which said water and chemical mixture is recovered and passed to the stock system of the process as diluted to a suitable concentration.

As a special application of the invention it is proposed that the method is applied to roll hydraulics, in particular to the lubrication of rolls journalled with slide bearings and/or to the pressurization and lubrication of the loading elements of hydraulically loaded rolls and the like.

Thus, in the method according to the invention, attempts are made to replace with water hydraulics in particular such oil hydraulics which is intended to produce remarkably high pressure levels. Slide bearings of rolls, internally loaded deflection-compensated rolls, band rolls, such as long-nip rolls and the like may be mentioned as examples of these. The use of water hydraulics provides substantial benefits over previous arrangements, one of the most important benefits being the fact that it is environmentally friendly. In respect of the operating medium, the system is very economical because the hydraulic oils conventionally used are relatively expensive. A significant advantage is also that the operating medium in water hydraulics is incombustible. If there occur any leakages in the system, these leakages will not contaminate its surroundings. This means that even large leakages will not cause problems, but in most cases the leakage waters can be discharged directly into the drain or into a treatment system of the circulation water of the paper machine. Owing to the low viscosity of water, no large-diameter pipes are needed in the system. Relatively long pipe lines are also possible. When changing over from oil hydraulics to water hydraulics, substantial alterations need not necessarily be made in the pipe lines especially if the pipe lines of oil hydraulics have already been made of an acid-proof material. The use of a water hydraulic system does not involve the air separation problem similar to that of oil hydraulic systems. A water hydraulic system does not require large storage tanks of the kind needed in oil hydraulic systems. In some instances, in water hydraulic systems it would also be possible to use sea water as the medium. The other advantages and characteristic features of the invention will come out from the following detailed description of the invention.

Table 1 shows a typical production capacity of a paper machine line.

Table 2 shows a balance sheet calculation of a paper production line for some polymer-based retention aids.

Table 3 shows a calculation of amounts of consumption of chemicals required at different viscosities.

Table 4 shows properties of and demand for one surface size starch for the production of Table 1.

DESCRIPTION OF THE PREFERRED EMBODIMENTS

It has already been stated earlier that the low viscosity of water constitutes a considerable problem for the use of water hydraulics in a paper machine. This problem becomes very clear in the sites of application which require a high pressure, such as, for example, in slide bearings and in loading elements of deflection-controlled rolls. The amounts of pure water which need to be pumped to provide a sufficient lubricating film would be unreasonably high, which means that the treatment of large amounts of water in confined spaces will constitute a problem. However, the viscosity of water can be raised with certain additives, in which connection by using this kind of additives the required water amounts can be brought to a level that can be controlled. Different polymer-based additives are relatively expensive, so that their use in view of mere water hydraulics becomes questionable in respect of costs.

However, in the papermaking process, different chemicals are used in different stages of the process, such as, fixatives and retention aids, which allow the viscosity of water to be raised. In the papermaking process, these substances are dosed to a given point in the process, to which they are passed as diluted to a suitable concentration, for example, to make the properties of stock as desired. The present invention utilizes chemicals which are fed to the process in any case and by means of which the viscosity of water is raised to such an extent that water hydraulics can be used, for example, in slide bearing arrangements of rolls, in loading of the loading elements of deflection-controlled rolls, as well as in resilient-shell rolls, in particular in long-nip rolls. This is sought to be illustrated by means of the figure in the accompanying fully schematic drawing.

Figure 1:
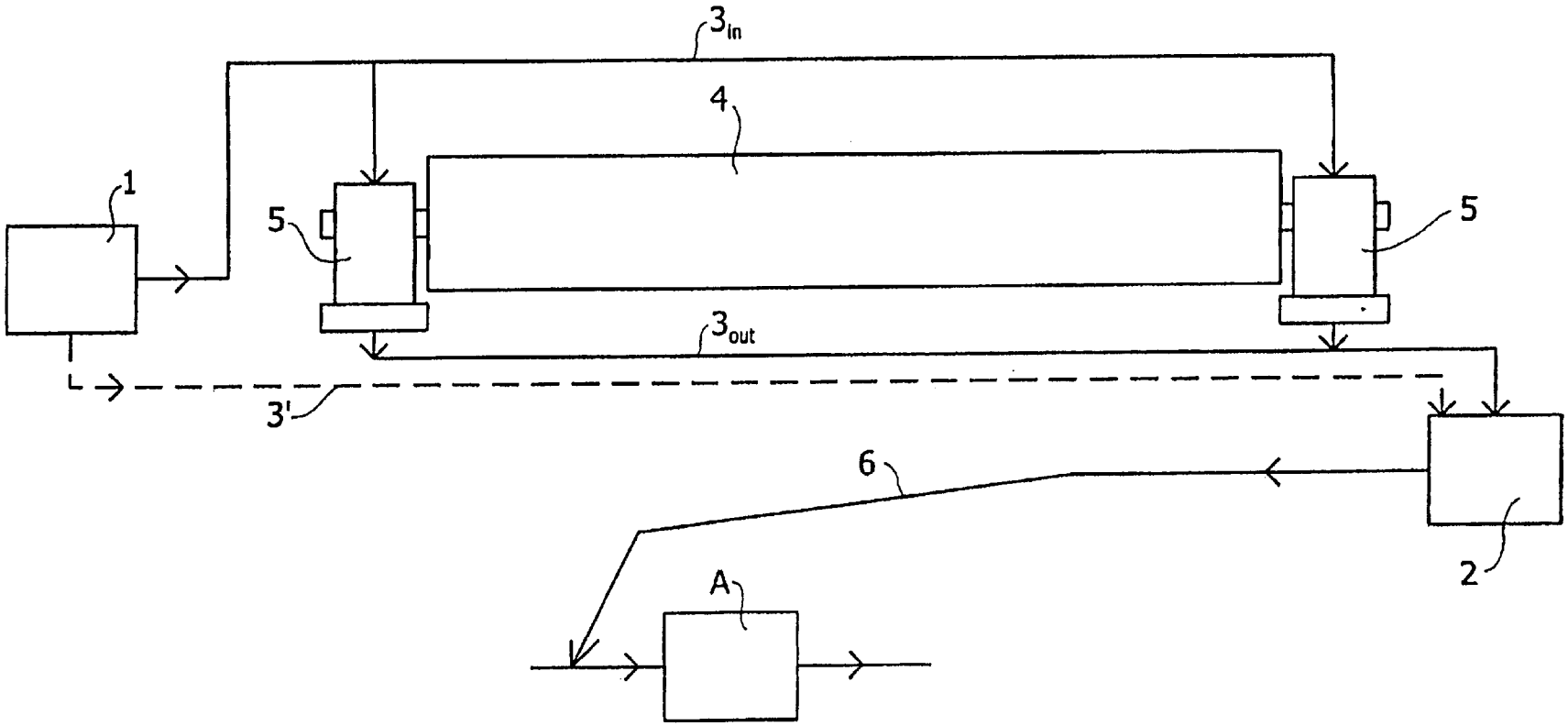
FIG. 1 of the drawing is a fully schematic view of a system according to the invention.

In the schematic FIG. 1 of the drawing, a treatment system and mixing tank for a polymer is denoted with the reference numeral 1. In this, the polymer is mixed with water to a desired concentration and, as a result of this, water obtains a given viscosity. In a conventional process circulation water system, the mixture of polymer and water has been passed along a feed line 3' into a polymer storage tank, which is denoted in the figure with the reference numeral 2. The polymer and water mixture is passed from said polymer storage tank 2, as suitably diluted, along a line 6 to a given process stage, which is schematically denoted with the reference sign A in the figure. The process stage A may be, for example, supply of stock to a wire section, i.e. to a headbox. Thus, as shown in FIG. 1, the substance is fed as diluted to a suitable concentration before the headbox. Since the circulation water systems of the paper machine are known in themselves, said system is not depicted in more detail in this connection.

In the system according to the invention shown in FIG. 1, the polymer and water mixture is not passed from the polymer mixing tank 1 directly into the polymer storage tank 2, but in the case shown in the figure relating to the use of water hydraulics for lubrication of the bearings of a roll, the polymer and water mixture is passed from the polymer mixing tank 1 along a feed line 3 in to bearings 5 of the roll 4. From the bearings 5 the polymer and water mixture is passed further along a line $\mathbf{3}_{out}$ into the polymer storage tank 2. Thus, in the polymer mixing tank 1, the polymer is mixed with water in a concentration such as to provide a viscosity required by the lubrication of the bearings 5 at a given flow through the bearings 5. Hence, this concentration is naturally higher than the concentration needed in the process because final dilution is not carried out until after the polymer storage tank 2.

Regarding the polymers used in the process, it may generally be stated that long-chain polymers are relatively short-lived, which means that the viscosity of the polymer and water mixture collapses after certain use. However, by modifying polymers, they can be made to last longer. Thus, short-chain polymers are superior to long-chain polymers. In the use according to the invention, the polymers must be such that they will not lose their characteristics when they are used, for example, in the manner shown in FIG. 1 for lubrication of bearings of a roll. If the properties changed substantially, for example, in the water hydraulic system shown in FIG. 1 while the polymer and water mixture flows through the bearings 5 and enters the storage tank 2, it would not necessarily be possible any more to use said polymers for their original purpose in the process.

Thus, the aim is that the polymer must be such that it can be used at least once without it losing its characteristics, for example, for lubrication of bearings, in which connection the polymer could also be utilized elsewhere in the process. Most commonly, it may be contemplated that the polymer is used 2 to 3 times, after which it must be renewed. Water is collected from suitable points of a paper or board machine, circulated into a tank or equivalent, filtered and cleaned, and passed into the polymer treatment system 1. The polymer treatment system is additionally supplied with a required amount of fresh water and of a new polymer such as to achieve a suitable concentration and viscosity.

Figure 2:
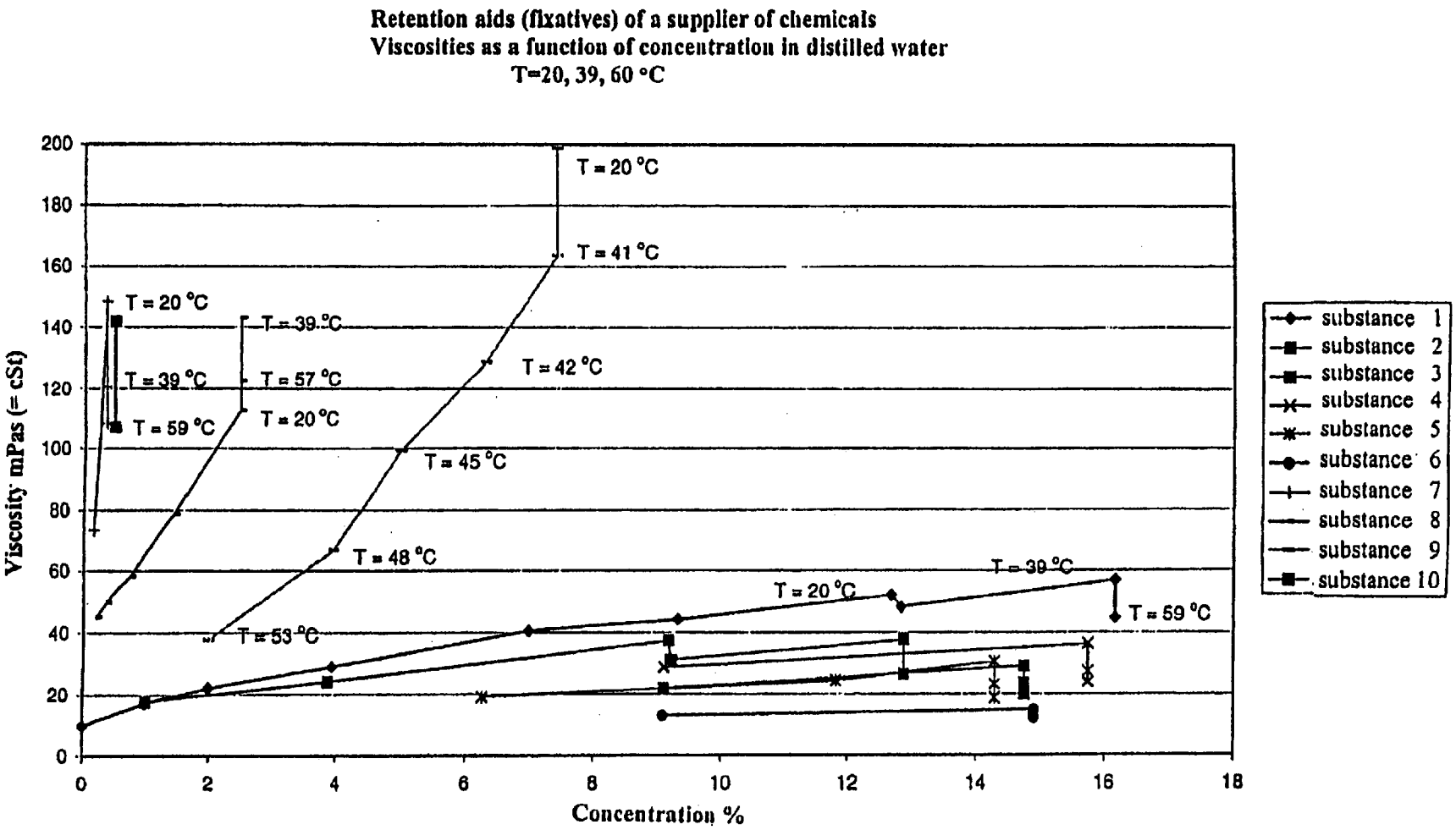
FIG. 2 shows the effect of chemicals used in a paper making process on the viscosity of water as a function of concentration.

The polymer may be a synthetic polymer or a biopolymer. FIG. 2 of the drawing shows the effect of different chemicals used in the papermaking process on the viscosity of water as a function of concentration. The chemicals mentioned in FIG. 2 are polymer-based retention aids, fixatives. In order to further illustrate the invention, in the tables described in the following, the amounts of consumption of several different chemicals (see FIG. 2) required in a bearing arrangement have been calculated at different viscosities and compared with the amount required by a paper machine line.

The retention aids shown in FIG. 2 as well as in Tables 2 and 3 are of the following type:

Substance 1: A cationic coagulant. A linear cationic polyelectrolyte having a low molecular weight, the active ingredient of which is a cross-linked epichlorohydrin dimethylamine (Epi-DMA) polymer.

Substance 2: A cationic coagulant. A linear cationic polyelectrolyte of low molecular weight, the active ingredient of which is PolyDADMAC.

Substance 3: A cationic coagulant, the active ingredients of which are PolyDADMAC and acrylic acid.

Substance 4: A cationic coagulant. A cross-linked cationic polymer of moderate molecular weight. The active ingredient is a cross-linked epichlorohydrin dimethylamine (Epi-DMA) polymer.

Substance 5: A cationic coagulant. A linear cationic polyelectrolyte of low molecular weight, the active ingredient of which is PolyDADMAC (some differences in physical characteristics as compared with the substance 2).

Substance 6: A cationic coagulant. A linear cationic polyelectrolyte of low molecular weight, the active ingredient of which is a linear Epi-DMA polymer.

Substance 7: A cationic emulsion flocculant. A synthetic cationic polyacryl-amide-copolymer-based flocculant of high molecular weight.

Substance 8: A cationic emulsion flocculant. A synthetic cationic polyacryl-amide-copolymer-based flocculant having a low molecular weight and a high cationic charge.

Substance 9: A cationic flocculant. A liquid cationic polymer of medium molecular weight, the active ingredient of which is an acrylamide copolymer.

Table 1 shows a typical production capacity of a paper machine line. Table 2 in turn shows a balance sheet calculation of a paper production line for some polymer-based retention aids. The substances shown in this table are the same as those in FIG. 2. Table 3 in turn shows a calculation of the amounts of consumption of said chemicals needed in a bearing arrangement of a roll at different viscosities.

In the following, the tables can be examined by means of an example. When looking, for example, at Table 2 and at the retention aid (Substance 1) appearing as the first in it, it can be seen that the demand for said retention aid with the production according to Table 1 is 3,969 kg/min at the maximum. Together with Tables 2 and 3 and taking account of what is shown in FIG. 2, it can be immediately noted that, firstly, in the slide bearing operation of a suction roll, the required viscosity is 20 cSt at a consumption of 146 l/min. By means of FIG. 2 it is seen, firstly, that the substance I provides the required viscosity at a concentration of 2%. In a corresponding way, at this concentration and flow, the consumption of the chemical is 3.4 kg/min. This amount is smaller than the maximum chemical demand with the production shown in Table 1 . In some cases, a lower viscosity is also sufficient, however, such that the value of 10 cSt can be regarded as the lower limit of the kinematic viscosity of the water and chemical mixture. Thus, said substance would be very suitable for use in raising the viscosity in the slide bearing operation of a suction roll because said chemical need not be introduced into the system for the actual slide bearing operation in a higher amount than that required by the production process itself.

For example, the starches used in surface sizes and coating slips of paper can be considered to be one noteworthy option of raising viscosity in the water hydraulic system. Table 4 shows properties of and demand for one surface size starch with the production of Table 1 . As Table 4 shows, with the production according to Table 1, the consumption of the surface size starch is 35.28 kg/min when the coated amount is 2 g/m$^2$. A concentration of 10% is used in coating, in which connection the total consumption of the surface size starch and water is 352,8 l/min. The viscosity of the solution at a temperature of 30 EC is 30 cSt. When the total amount as an aqueous solution is compared with the consumption required in the slide bearing operation, it is immediately noted that the total amount of the surface size starch in an aqueous solution needed for surface sizing is much higher than the consumption of the aqueous solution needed for the slide bearing operation of a suction roll and a press roll. Thus, the aqueous solution of the surface size starch could be passed through the bearing arrangement before it is fed to the size press. As a possible drawback with the use of such a substance, clogging of components and pipes might be envisaged, in particular during shutdowns. This could, however, be avoided by the fact that during shutdowns, the system is always rinsed in order that no surface size starch shall remain in the pipes and components. The startup of the system is also problem-free because, for example, when starting presses, calenders and others, said devices are in an unloaded state. In that connection, a lower concentration of the loading medium is sufficient, wherefore there is no risk of clogging at the startup stage, either.

The use of water hydraulics is particularly advantageous in the bearing arrangements of wire and press section rolls, such as suction rolls, prepress rolls and the like, because the requirements set on sealing of the bearing arrangement are not anywhere near as high as when oil is used. In these cases, lubricating water can be passed, for example, through a suction box and a suction duct out of the roll. In that connection, it is also possible to construct a closed lubrication circulation for the bearing arrangement.

Above, the invention has been described by means of examples, to which the invention is, however, not intended to be exclusively confined. Accordingly, the different embodiments of the invention may vary within the inventive idea defined in the accompanying claims.

TABLE 1

Production capacity of a paper machine line (example)

| | | |
|---|---|---|
| Web width | 9800 | mm |
| Basis weight | 45 | g/m$^2$ |
| Running speed | 1800 | m/min |
| Production | 793.8 | Kg/min |
| Annual production | 417,221 | tonnes |

TABLE 2

Balance sheet calculation of a paper production line for some polymer-based retention aids (fixatives)

| | Dosage | | Concentration in slide | | | Dosage | | Demand/production (with the production of Table 1) | | |
|---|---|---|---|---|---|---|---|---|---|---|
| | Concentration | | bearing operartion | | Density | min | max | min | max | |
| Substance | min % | max % | min % | max % | kg/dm³ | kg/tonne | kg/tonne | kg/min | kg/min | Location |
| Substance 1 | | 0.25 | 2 | | 1.16 | 0.5 | 5 | 0.397 | 3.969 | stock/broke line |
| Substance 2 | | 0.25 | 9 | | 1.18 | 0.5 | 5 | 0.397 | 3.969 | stock/broke line |
| Substance 3 | | 0.25 | 3 | | 1.04 | 0.5 | 5 | 0.397 | 3.969 | stock/broke line |
| Substance 4 | | 0.25 | 9 | | 1.18 | 0.5 | 5 | 0.397 | 3.969 | stock/broke line |
| Substance 5 | | 0.25 | 7 | | 1.06 | 0.5 | 5 | 0.397 | 3.969 | stock/broke line |
| Substance 6 | | 0.25 | — | | 1.18 | 0.5 | 5 | 0.397 | 3.969 | stock/broke line |
| Substance 7 | 0.05 | 1.0 | 0.1 | 0.3 | 1.04 | 0.3 | 1 | 0.238 | 0.794 | before headbox |
| Substance 8 | 0.1 | 0.5 | 0.2 | 2.5 | 1.01 | 0.5 | 2 | 0.397 | 1,588 | before headbox |
| Substance 9 | 0.01 | 0.1 | 2 | 6 | 1.23 | 0.5 | 5 | 0.397 | 3.969 | before headbox |

TABLE 3

Amounts of consumption of water viscosity improving agents (Table 2) required for bearing systems of rolls at different viscosities

| | | Substance 1 | | Substance 2 | | Substance 3 | | Substance 4 | |
|---|---|---|---|---|---|---|---|---|---|
| viscosity of water | consumption of water | concen-tration % | consumption kg/min | concen-tration % | Consump-tion kg/min | concen-tration % | consump-tion kg/min | concen-tration % | consump-tion kg/min |
| Suction roll journalled with slide bearings | | | | | 15.5 | | | | |
| 20 cSt | 146 l/min | 2.0 | 3.4 | 9.0 | | 3.0 | 4.6 | 9.0 | 15.5 |
| 40 cSt | 117 l/min | 7.0 | 9.5 | | | 9.0 | 11.0 | | |
| 80 cSt | 82 l/min | | | | | | | | |
| Slide bearing arrangement in a press roll | | | | | 25.8 | | | | |
| 20 cSt | 300 l/min | 2.0 | 5.6 | 9.0 | | 3.0 | 9.4 | 9.0 | 31.9 |
| 40 cSt | 243 l/min | 7.0 | 24.4 | | | 9.0 | 22.7 | | |
| 100 cSt | 153 l/min | | | | | | | | |
| 150 cSt | 114 l/min | | | | | | | | |
| Shoe press | | | | | | | | | |
| 150 cSt | 70 l/min/m | | | | | | | | |
| 40 cSt | 150 l/min/m | 7.0 | 119.4 | | | 9.0 | 137.6 | | |

| | | Substance 5 | | Substance 7 | | Substance 8 | | Substance 9 | |
|---|---|---|---|---|---|---|---|---|---|
| viscosity of water | consumption of water | concen-tration % | consumption kg/min | concen-tration % | Consump-tion kg/min | concen-tration % | consump-tion kg/min | concen-tration % | consump-tion kg/min |
| Suction roll journalled with slide bearings | | | | | | | | | |
| 20 cSt | 146 l/min | 7.0 | 10.8 | | | | | | |
| 40 cSt | 117 l/min | | | | 0.1 | 0.2 | 0.2 | 2.0 | 2.9 |
| 80 cSt | 82 l/min | | | 0.2 | | | | | |
| Slide bearing arrangement in a press roll | | | | | | | | | |
| 20 cSt | 300 l/min | 7.0 | 22.3 | | | | | | |
| 40 cSt | 243 l/min | | | | | 0.2 | 0.5 | 2.0 | 6.0 |
| 100 cSt | 153 l/min | | | | 0.4 | | | | |
| 150 cSt | 114 l/min | | | 0.4 | | | | | |
| Shoe press | | | | | 2.6 | | | | |
| 150 cSt | 70 l/min/m | | | 0.4 | | | | | |
| 40 cSt | 150 l/min/m | | | | | 0.2 | 3.0 | 2.0 | 36.2 |

TABLE 4

Properties of and demand for one surface size starch for the production of Table 1

| Surface size starch | | | viscosity of water | consumption of water |
|---|---|---|---|---|
| density of starch | 1 kg/dm$^3$ | | Suction roll journalled with slide bearings | |
| coating amount | 2 g/m$^2$ | | 20 cSt | 146 l/min |
| total amount | 35.28 kg/min | | 40 cSt | 117 l/min |
| concentration | 10% | | 80 cSt | 82 l/min |
| total amount | 352.8 l/min | | Slide bearing arrangement in a press roll | |
| as aqueous solution | | | 20 cSt | 300 l/min |
| viscosity | [30° C.] | 30 cSt | 40 cSt | 243 l/min |
| | [50° C.] | 15 cSt | 100 cSt | 153 l/min |
| | | | 150 cSt | 114 l/min |
| | | | Shoe press | |
| | | | 150 cSt | 70 l/min/m |
| | | | 40 cSt | 150 l/min/m |

We claim:

1. A method for using water hydraulics in a paper on board machine, for lubrication subjected to pressure, wherein some chemical used in stock system of a process is mixed with the water used in the water hydraulics before the water is passed to a site of application in order to raise the viscosity of the water and chemical mixture to a level required by the site of application; and the water and chemical mixture is passed to the site of application and circulated through the same at least once, after which said water and chemical mixture is recovered and passed to the stock system as diluted to a suitable concentration.

2. The method of claim 1, wherein the water and chemical mixture is applied to the site of application selected from the group consisting of: roll hydraulics, lubrications of rolls journalled with slide bearings, pressurization and lubrication of loading elements of hydraulically loaded rolls.

3. The method of claim 1, wherein the chemical is mixed with water in a concentration such that the kinematic viscosity of the water an chemical mixture is at a level of at least 10 cSt.

4. The method of claim 1, wherein in the chemical used is a retention aid, fixative, or starch used in the stock system.

5. The method of claim 1, wherein the chemical is such that at a given viscosity of the water and chemical mixture and at its resultant consumption of the mixture, the consumption of the chemical is lower than the demand for said chemical in the stock system.

6. The method of claim 1, wherein the chemical used is surface size starch.

7. A method for using water hydraulics in a paper or board machine, in applications requiring lubrication in which an operating medium is subjected to pressure, comprising the steps of: forming paper or board from a stock containing water and a selected chemical;

before forming the paper or board, mixing with water the selected chemical to form a water and chemical mixture with viscosity raised to a level required in lubrication where the water and chemical mixture is subjected to pressure;

circulating the water and chemical mixture at least once through a site requiring lubrication and forming a part of the paper or board machine; and recovering the water and chemical mixture from the site requiring lubrication, and diluting the water and chemical mixture in a stock system to form the stock.

8. The method of claim 7, wherein the site requiring lubrication includes at least one site selected from the group consisting of: roll hydraulics, roll journal, slide bearings of rolls, lubrication of loading elements of hydraulically loaded rolls, internally loaded deflection-compensated rolls, band rolls, long-nip rolls, prepress rolls bearing arrangements of press section rolls, and bearing arrangements of suction rolls.

9. The method of claim 7, wherein the selected chemical is mixed with water in a concentration such that the kinematic viscosity of the water and chemical mixture is at a level of at least 10 cSt.

10. The method of claim 7, wherein the selected chemical is selected from the group consisting of: a retention aid, a fixative, and starch used in the stock.

11. The method of claim 7, wherein the selected chemical is such that at a given viscosity of the water and chemical mixture and at its resultant consumption of the selected chemical, the consumption of the chemical is lower than the demand for said chemical in the stock system.

12. The method of claim 7, wherein in the selected chemical is surface size starch.

13. A method of lubricating sites forming part of a paper or board machine, comprising the steps of:

forming a lubricating fluid by mixing a first concentration of a chemical, of the type used to form a stock system, with water, to form a water and chemical mixture with a kinematic viscosity of at least 10 cSt;

lubricating at least one site forming a part of the paper or board machine with the water and chemical mixture;

recovering the water and chemical mixture from at least one site, and further diluting the water and chemical mixture in the stock system to a second concentration to form the stock; and forming a web on the page or board machine using the stock.

14. The method of claim 13 wherein the kinematic viscosity is between 20 and 150 cSt.

15. The method of claim 13 wherein the chemical is selected from the group consisting of: a cross-linked epichlorohydrin dimethylamine (Epi-DMA) polymer, PolyDADMAC, acrylic acid, a synthetic cationic polyacrylamide-copolymer-based flocculant of high molecular weight, a synthetic cationic polyacryl-amide-copolymer-based flocculant having a low molecular weight and a high cationic charge, and an acrylamide copolymer.

16. The method of claim 13, wherein the selected chemical is selected from the group consisting of: a retention aid, a fixative, and starch used in the stock.

17. The method of claim 13, wherein the selected chemical is such that at a given viscosity of the water and chemical mixture and at its resultant consumption of the selected chemical, the consumption of the chemical is lower than the demand for said chemical in the stock system.

18. The method of claim 13, wherein the selected chemical is surface size starch.

19. A method which allows the use of water hydraulics in a paper or board machine in which the operating medium is subjected to a considerable pressure, comprising the steps of:

mixing some chemical used in stock system of a process with water used in water hydraulics to form a water chemical mixture in order to raise the kinematic viscosity of the water chemical mixture to at least 10 cSt followed by;

passing the water chemical mixture used in water hydraulics to a site of application followed by;

circulating the water chemical mixture used in water hydraulics through the site at least once, after which said water chemical mixture used in water hydraulics is recovered and passed to the stock system of the paper or board machine and diluted to a suitable concentration.

20. The method of claim 19 wherein the kinematic viscosity is between 20 and 150 cSt.

21. The method of claim 19 wherein the chemical is selected from the group consisting of: a cross-linked epichlorohydrin dimethylamine (Epi-DMA) polymer, PolyDADMAC, acrylic acid, a synthetic cationic polyacryl-amide-copolymer-based flocculant of high molecular weight, a synthetic cationic polyacryl-amide-copolymer-based flocculant having a low molecular weight and a high cationic charge, and an acrylamide copolymer.

22. The method of claim 19, wherein the selected chemical is selected from the group consisting of: a retention aid, a fixative, and starch used in the stock.

23. The method of claim 19, wherein the selected chemical is such that at a given viscosity of the water and chemical mixture and at its resultant consumption of the selected chemical, the consumption of the chemical is lower than the demand for said chemical in the stock system.

24. The method of claim 19 wherein the selected chemical is surface size starch.

* * * * *